US006209155B1

(12) United States Patent
Epstein et al.

(10) Patent No.: US 6,209,155 B1
(45) Date of Patent: Apr. 3, 2001

(54) FASTENER FOR ADJUSTABLE CROSS BAR FOR BED RAILS AND FRAMES

(75) Inventors: Andrew U. Epstein; Aaron Fredman, both of St. Louis, MO (US)

(73) Assignee: Fredman Bros. Furniture Company, Inc., St. Louis, MO (US)

( * ) Notice: Subject to any disclaimer, the term of this patent is extended or adjusted under 35 U.S.C. 154(b) by 0 days.

(21) Appl. No.: 09/277,630

(22) Filed: Mar. 26, 1999

(51) Int. Cl.[7] ..... A47C 19/00

(52) U.S. Cl. ..... 5/201; 5/181; 5/282.1; 5/285

(58) Field of Search ..... 5/200.1, 201, 202, 5/236.1, 282.1, 285, 181, 185, 175

(56) References Cited

U.S. PATENT DOCUMENTS

| | | | | |
|---|---|---|---|---|
| Re. 27,182 | | 9/1971 | Fredman . | |
| 2,877,470 | * | 3/1959 | Roth | 5/181 X |
| 3,031,689 | | 5/1962 | Sark . | |
| 3,646,623 | * | 3/1972 | Harris et al. | 5/181 |
| 3,803,644 | * | 4/1974 | Harris | 5/181 |
| 3,848,280 | | 11/1974 | Allen et al. . | |
| 3,945,064 | * | 3/1976 | Harris et al. | 5/181 |
| 4,038,710 | | 8/1977 | Tambascio . | |
| 4,078,271 | | 3/1978 | Tambascio . | |
| 4,080,674 | | 3/1978 | Fredman et al. . | |
| 4,103,374 | | 8/1978 | Knoke . | |
| 4,135,266 | * | 1/1979 | Knoke | 5/201 |
| 4,276,665 | * | 7/1981 | Mis | 5/185 X |
| 4,295,234 | * | 10/1981 | Whitehead | 5/202 X |
| 4,354,287 | | 10/1982 | Fredman . | |
| 5,161,268 | * | 11/1992 | Harrow | 5/201 |
| 5,203,039 | | 4/1993 | Fredman . | |
| 5,231,713 | | 8/1993 | McDonnell . | |
| 5,477,571 | | 12/1995 | Roggenkamp et al. . | |
| 5,502,852 | | 4/1996 | Fredman et al. . | |

OTHER PUBLICATIONS

Muscle 2000 Advertisement (Date Unknown).
Glideaway's "Fit For A Queen" Brochure (Date Unknown).
Glideaway "Bed Rails And Frames . . . And Bedding" Brochure (Date Unknown).

* cited by examiner

*Primary Examiner*—Terry Lee Melius
*Assistant Examiner*—James M Hewitt
(74) *Attorney, Agent, or Firm*—Polster, Lieder, Woodruff & Lucchesi, L.C.

(57) ABSTRACT

An adjustable cross bar for bed rails and frames with at least two relatively movable cross bar members and a clamp positioned over the inboard ends of the cross bar members and entrapping their edges in tracks. The clamp has depending lances formed in a horizontal surface aligned with and engagable with openings formed in one of the cross bar members to lock the clamp and cross bar together.

10 Claims, 3 Drawing Sheets

FASTENER FOR ADJUSTABLE CROSS BAR FOR BED RAILS AND FRAMES

BACKGROUND OF THE INVENTION

1. Field of the Invention

This invention relates to beds with metal or wooden bed rails and metal bed frames which have metal adjustable cross bars with or without legs on the cross bars. While this invention is particularly applicable to queen and king size beds which require legs on the cross bars to support the extra width and weight of such beds and bedding, it also is applicable to full and twin size beds.

Specifically this invention is related to adjustable angle iron cross bars for bed rails and frames designed for use with various sized beds and to a device for fastening the parts of the adjustable angle iron cross bars together to protect the rails and support the bedding.

2. Description of the Prior Art

Conventional beds and bed rails require longitudinally spaced, transversely extending wooden or metal slats extending between the side rails. The side rails tend to warp, twist outwardly or deflect under the weight of the box spring and other bedding components which cause the box spring to sag. This especially is a problem with wider span beds and bedding, such as, queen size and king size widths, since the wider bedding is heavier as well as being wider and longer. Slats setting on angle iron or wood rails not only push the rails downwardly, but also push the rails outwardly when weight is placed on the slats. This is a critical problem as the twisting or torquing of the rails frequently cause the bed legs to split when the slot in the legs of the beds is too close to the outside edge of the leg, or cause the bed legs to split away from the end board. These slats are normally 1" thick or less and create a sway in the box spring between one slat and the next, thereby weakening the frame of the box spring.

Prior U.S. Pat. No. 4,080,674 issued Jan. 3, 1977 discloses metal bed rails for queen size beds which eliminate the use of transverse slats and are interconnected by a centrally located angle iron rigid cross member with legs and adjustable glides. By extending the threaded glides to contact the floor they prevent the boxspring from sagging and eliminate undue stress on the side rails and bed legs.

U.S. Pat. No. 5,203,039 discloses an adjustable cross bar and foldable adjustable legs. U.S. Pat. No. 5,502,852 is an improvement on the adjustable leg structure of U.S. Pat. No. 5,203,039. The present invention is an improvement on the adjustable cross bar shown in U.S. Pat. No. 5,203,039 and eliminates the "C" shaped clamp and thumb screw tightener used in the cross bar of U.S. Pat. No. 5,203,039 which has a tendency to work loose, while providing easier adjustment in length and greater rigidity to the extended cross bar.

BRIEF SUMMARY OF THE INVENTION

It is a primary object of the present invention to provide an adjustable cross bar construction to fit king and queen sized beds which is simple and inexpensive to fabricate, which provides good rigidity in extended position, and which can be adjusted easily by the user.

Another object is to provide a cross bar, which is adjustable in width to accommodate different width beds and still can be packaged in a compact inexpensive package. Another object is to provide a clamp which is stronger than screw down clamps, is more rapidly and more easily assembled by the user, allows for pre-assembly of the product for shipping, and the entire product fits into one carton. Another object is to provide a clamp and adjustable cross bar construction in which the weight of the mattress and the user urges the clamp into a tighter grip on the cross bar sections to increase the clamping pressure and prevent separation of the parts. These and other objects and advantages will become apparent hereinafter.

This invention comprises an adjustable cross bar having one or more adjustable portions with a slip-on locking bracket to hold in place the adjustable portions and rigidify the extended cross bar.

BRIEF DESCRIPTION OF THE SEVERAL VIEWS OF THE DRAWINGS

In the drawings wherein like numbers refers to like parts wherever they occur.

In the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 4:
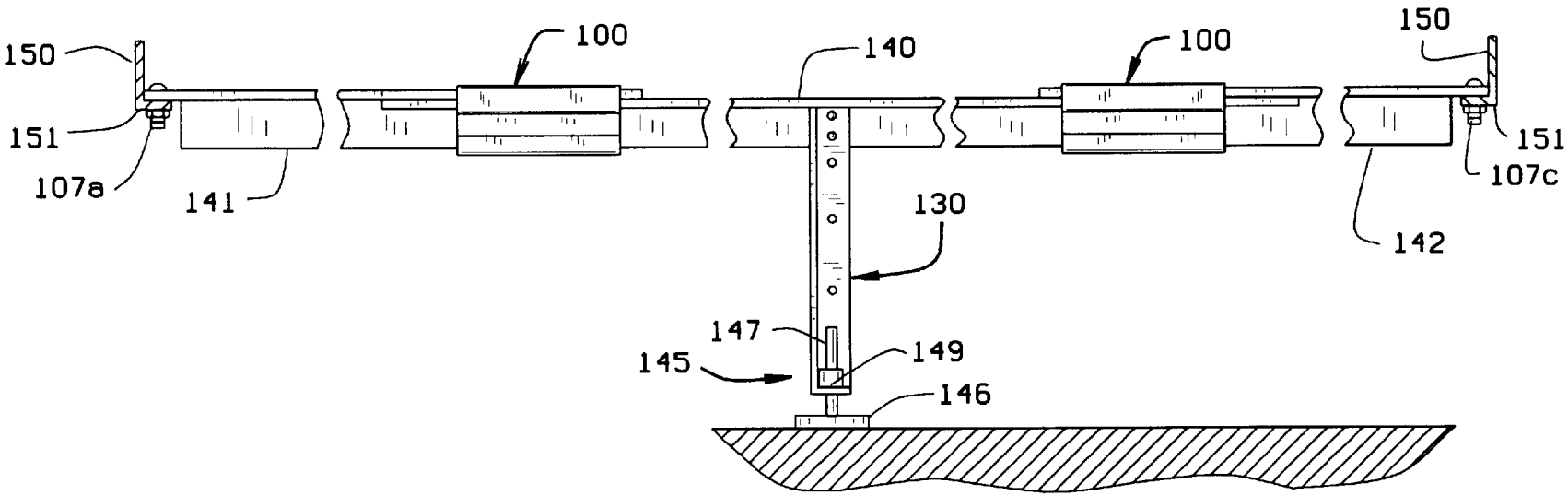
FIG. 4 is a fragmentary sectional view of a modification of this invention showing two adjustable cross bars and a single support leg and showing metal siderails.

This invention is an improvement on the adjustable cross bar connector shown in detail in FIG. 4 of U.S. Pat. No. 5,203,039 and identified by numerals 20–25 of that patent. The structures of U.S. Pat. Nos. 5,203,039 and 5,502,852 are herein incorporated by reference to the extent necessary to define a background for a completion of the present disclosure.

The main improvement of the present invention is the fastening bracket 100 which slidably attaches the main cross bar member 101 to the adjustable cross bar member 102.

The main cross bar member 101 is an "L" angle, which has a horizontal flange or web 103 and a right angle vertical flange or web 104. The vertical flange 104 terminates at 105 inwardly from the outboard edge 106 of the horizontal flange 103. This defines a cut-out area which engages the inside of side rail 107 while the horizontal flange 103 has an opening 108 which overlaps the lip 107*a* of the side rail 107 and accommodates a screw (not shown) or other suitable means for fastening the main cross member 101 to the side rail 107. The adjustable cross bar member 102 likewise has a vertical flange 109 and a horizontal flange 110. The flanges 103, 110 and 104, 109 are of approximately equal size. The outboard end 111 of the adjustable cross member 102 is of similar construction to the outboard edge 106 of the main flange 101 and includes an opening 108 to accommodate a screw or other suitable fastener to attach the cross bar 102 to the side rail lip 107*a*. The main cross bar member 101 is provided with spaced openings 112 in the horizontal flange 103 adjacent to its inboard end 113. When the siderail 107 and lip 107*a* are wood, screws 107*b* are used to fasten the cross bar members 101, 102 to the lip 107*a*. When the side rail 107 and lips 107*a* are metal (FIG. 4), bolts and nuts 107*c* are used. The outboard edges 106, 111 of the cross bar members 101, 102 can be forced against the insides of the side rails 107 to lock the cross bar in position without fastening to the lips 107*a*.

Figure 3:
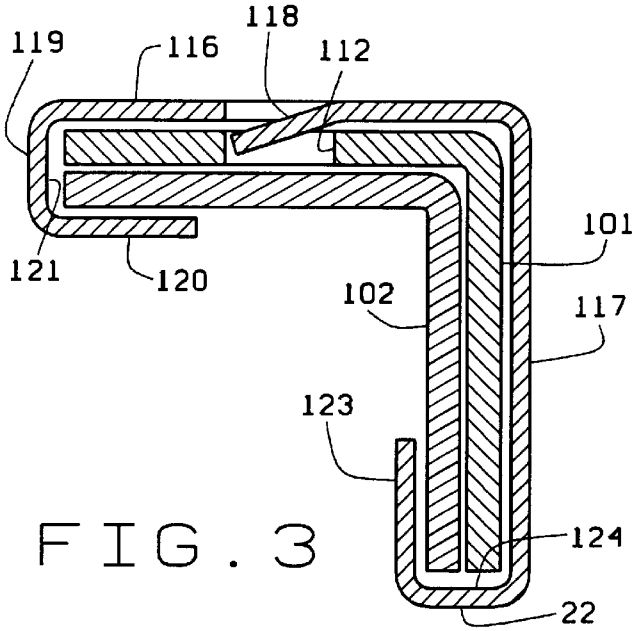
FIG. 3 is a vertical sectional view taken along line 3—3 of FIG. 1.

The bracket 100 preferably is about 6 inches in length for a bed cross bar, but can be any length for other applications as long as its sufficiently long to provide rigidity and strength to the extended cross bar. The bracket 100 has a horizontal flange 116 and a vertical right angular flange 117. The horizontal flange 116 is aligned with the horizontal flanges 103, 110 of the cross bar members 101, 102. The horizontal flange 116 is provided with laterally spaced inwardly directed lances or tabs 118, which are aligned with and designed to engage the main cross bar openings 112. The lances 118 depend from the flange 116 and are partially severed in forming. They are bent downwardly into the body of the bracket 100. The horizontal flange 116 of bracket 100 has a right angular vertical flange 119 and an inturned lip 120 which all define a horizontal track 121. The vertical flange 117 of the bracket 100 has a right angular horizontal flange 122 and an upturned lip 123 which all define a vertical track 124. This is most clearly shown in FIG. 3.

Figure 1:
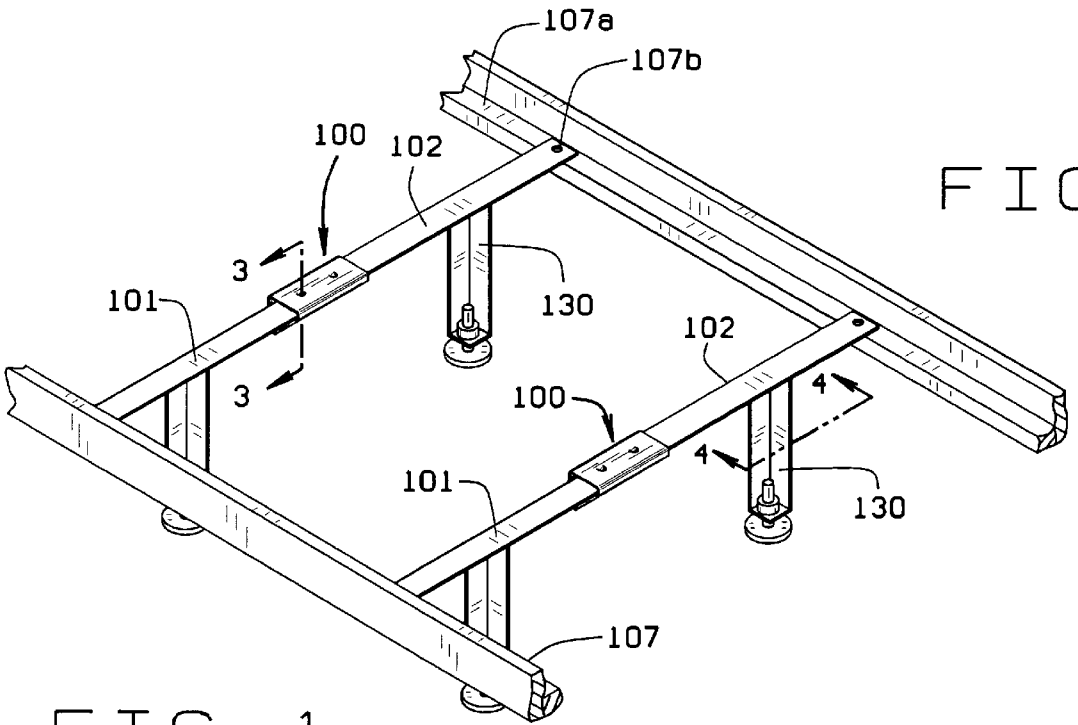
FIG. 1 is a fragmentary perspective view of the cross bar of this invention installed on wood siderails.
Figure 2:
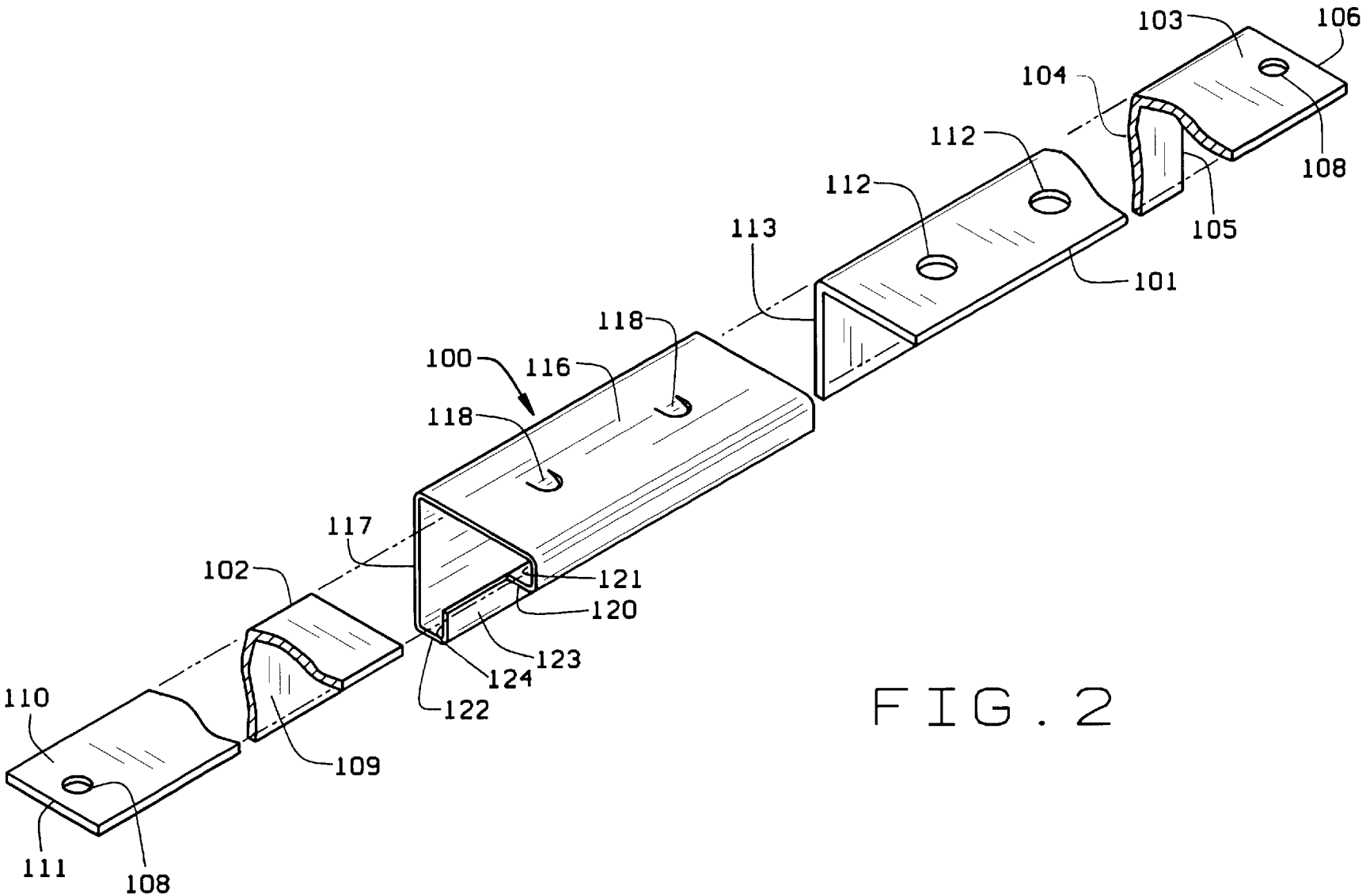
FIG. 2 is an exploded fragmentary perspective view of the cross bar shown in FIG. 1.

The tracks 121 and 124 are sized to accommodate the cross bar members 101 and 102 in a relatively sliding arrangement. The bracket 100 is fastened to the main cross member 101 by the engagement of the lances 118 in the openings 112. When the adjustable member 102 is slid into bracket 100 it forces lances 118 into the openings 112 of the main cross bar member 101. Thus the bracket 100 is fixed to the main member 101 while the adjustable member 102 is still adjustable with respect to the main member 101 and can be extended to the necessary width to bridge the distance between the bed side rails 107. Thus the cross bar members 101, 102 can be collapsed or extended to accommodate different bed widths without using tools and results in a strong joint and a rigid cross member. As previously noted, the ends 106, 111 of the cross bar members 101, 102 can be firmly seated against the inside edges of the bed rails 107 and will resist rotation or other movement. Adjustable legs 130 are attached to the cross bar members 101, 102 to support the cross bar assembly as shown in FIG. 1. An important aspect of this invention is that the bracket horizontal flange 116 and the lances 118 are aligned with the cross member horizontal flanges 103, 110 so that the weight of springs, mattresses and users urges the lances 118 into engagement with the openings 112 to strengthen the grip between the flange 100 and the cross bar members 101, 102.

FIG. 4 shows a modification of the invention which utilizes a center main cross bar 140 and two adjustable side cross bar members 141 and 142. The side bar members 141, 142 are identical and are adjustably retained to the center bar 140 by two identical brackets 100 which are the same as that described hereinbefore. There is only a single center leg 130, which also is identical to that shown in FIG. 1. The vertically adjustable foot 145 is similar to that shown in U.S. Pat. No. 5,502,852 and includes a pad 146, a threaded stem 147 attached thereto, and a plastic bushing 148 mounted in an integral bracket 149. To adjust the height of the leg 130, the stem 147 and foot 145 are rotated through the bushing 148. An extension member (not shown) which is similar to that shown in FIG. 8 of U.S. Pat. No. 5,502,852 also can be used with this invention to raise the bed level up to about 18 inches.

FIG. 4 also shows the use of metal side rails 150 and lips 151 and the use of a bolt and nut 107*c* to attach the cross bar to the lips 151. This invention is equally applicable to wooden or metal side rails and to two or three piece adjustable cross bars.

This invention is intended to cover all changes and modifications of the example of the invention herein chosen for purposes of the disclosure which do not constitute departures from the spirit and scope of the invention.

The clamps of this invention also is applicable to U-shaped interlocking adjustable sections, and to rectangular, square or other shaped interlocking sections provided there is one horizontal surface to accept the lances and openings.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. The combination of a clamp and first and second laterally movable members comprising:

a first member having a horizontal surface provided with openings therein, said first member having an outboard end adapted to engage a first fixed side element, and an inboard free end, a second member nested inside the first member and laterally movable with respect to said first member, said second member having an outboard end adapted to engage a second fixed side element laterally spaced from the first fixed side element and an inboard end adjacent to the inboard end of the first member, and a clamp embracing portions of the inboard ends of the first and second members and retaining said members in aligned and laterally slidable relationship, said clamp having a body with a horizontal flange defining one side thereof, said horizontal flange being juxtaposed to the horizontal surface of the first member, downwardly formed areas on the clamp horizontal flange aligned with and engagable in the openings in the first member horizontal surface to lock the clamp to the first member and retain the inboard ends of the first and second members in aligned relationship while still allowing unrestricted lateral movement of the members whereby the outboard ends are movable into engagement with the respective fixed side elements.

2. The combination of claim 1 wherein the first and second members are "L" shaped and the clamp is substantially similarly shaped with a horizontal and a vertical track embracing the inboard ends of the first and second members.

3. The combination of claim 1 wherein the downwardly formed areas on the clamp are depending lances partially cut from the horizontal flange and bent downwardly into the body of the clamp.

4. The structure of claim 1 wherein the first and second members have horizontal and vertical webs with the vertical webs having notches at the outboard ends.

5. The structure of claim 1 wherein the clamp is about 6 inches in length.

6. A bed frame comprising opposed side rails having inwardly directed lips, at least one cross bar assembly interconnecting the side rails and residing on said lips, the cross bar assembly being adjustable in length to accomodate the spacing of the side rails, the cross bar assembly comprising:

first and second nested "L" angle cross bar members defined by vertical and horizontal webs, the vertical webs having free longitudinal edges adjacent to each other and the horizontal webs having free longitudinal edges adjacent to each other, said first "L" angle cross bar member having a horizontal surface provided with an opening therein, said first member having an outboard end adapted to be fastened to one of said side rail lips, and an inboard free end, said second "L" angle cross bar member being laterally movable with respect to said first member, said second member having an outboard end adapted to be fastened to the other side rail lip, and an inboard end adjacent to and overlapping the inboard end of the first member, and a clamp embracing portions of the overlapping inboard ends of the first and second members and retaining said members in aligned and laterally slidable relationship, said clamp having a body defined by a horizontal flange and a vertical flange connected thereto, the horizontal and vertical flanges each having a free end with track members formed on the free ends, said clamp horizontal flange being juxtaposed to the horizontal surface of the first member, said tracks embracing the free longitudinal edges of the cross bar members allowing sliding movement between the members, the clamp horizontal surface having at least one depending tab which engages said opening in the horizontal surface of said first cross bar member to prevent relative movement between said clamp and said first cross bar member and retaining the inboard ends of the first and second members in aligned relationship while still allowing unrestricted lateral movement of the members whereby the outboard ends are movable into engagement with the respective side rails.

7. The structure of claim 6 wherein the vertical webs of the cross bar members have notches at the outboard ends and the horizontal webs are fastened to the said rail lips.

8. The structure of claim 6 wherein the clamp is about 6 inches in length.

9. The cross bar assembly of claim 6 wherein there are two cross bar members and one clamp.

10. The cross bar assembly of claim 6, wherein there are three cross bar members and two clamps.

* * * * *